US006085484A

United States Patent [19]

Ban

[11] Patent Number: 6,085,484

[45] Date of Patent: Jul. 11, 2000

[54] BUILDING STRUCTURE

[76] Inventor: Shigeru Ban, 5-2-4, Matsubara, Setagaya-ku, Tokyo, Japan

[21] Appl. No.: 09/393,494

[22] Filed: Sep. 10, 1999

Related U.S. Application Data

[63] Continuation-in-part of application No. 08/685,247, Jul. 23, 1996, abandoned.

[30] Foreign Application Priority Data

Jan. 18, 1995 [JP] Japan ..... 7-23488

[51] Int. Cl.[7] ..... E04C 3/36

[52] U.S. Cl. ..... 52/736.1; 52/736.3; 52/737.4; 52/738.1; 138/154; 428/34.2; 428/377; 428/398

[58] Field of Search ..... 52/736.1, 731.4, 52/731.5, 731.2, 732.1, 732.3, 736.3, 737.4, 738.1; 138/129, 154, 177; 428/537.5, 534, 34.2, 34.3, 377, 371, 398

[56] References Cited

U.S. PATENT DOCUMENTS

| | | | |
|---|---|---|---|
| 4,462,556 | 7/1984 | Graham, Jr. | 138/154 |
| 5,131,325 | 7/1992 | Blauvelt | 138/154 |

*Primary Examiner*—Christopher T. Kent
*Attorney, Agent, or Firm*—Trapani & Molldrem

[57] ABSTRACT

A building structure comprising a paper strip formed into a cylindrical shape by spirally winding the same and securing adjacent opposed portions thereof by means of adhesives. The building structure has a peeling strength of not less than 13.0 kg/cm$^2$ and a compression strength of not less than 250 kg/cm$^2$, which can be used for manufacturing interior and exterior walls of buildings in simple steps, rapidly and at a reduced manufacturing cost.

4 Claims, 5 Drawing Sheets

O : LONGITUDINAL STRAIN
▲ : LATERAL STRAIN
LOAD ( t )
5.0
4.0
3.0
2.0
1.0
0
1.0
2.0
3.0
4.0
5.0
6.0
STRAIN ( X 10⁻³ )
COMPRESSION TEST LOAD-STRAIN RELATIONSHIP
(A OUTER DIAMETER: 150.75mm. INNER DIAMETER 124.69mm
CROSS SECTIONAL AREA A = 56.38cm²)

RELATIONSHIP BETWEEN HUMIDITY AND DISPLACEMENT UPON MEASUREMENT

BUILDING STRUCTURE

This is a continuation of my co-pending U.S. patent application Ser. No. 08/685,247, filed Jul. 23, 1996, now abandoned.

BACKGROUND OF THE INVENTION

1. Field of the Invention

The present invention concerns a building structure and, more specifically, it relates to a building structural member or element capable of constituting interior or exterior walls of buildings.

2. Description of the Prior Arts

There are buildings such as a meeting hall, not to be used for a long time after construction but used only for a relatively short period of term for holding entertainments and then dismantled after use, or buildings such as a tent or a medical facility disposed in refugee's camp to be used for a predetermined period of term and then dismantled and carried back. It is desirable for the construction of such buildings to use building structural member or element which are light in weight and which convenient to transport and can be manufactured at as low production cost as possible.

Heretofore, solid lumber or concrete, port or pillows have been used as building structural members capable of constituting interior and exterior walls of buildings, and the interior and exterior walls for the buildings are constituted by arranging such building structural element in a row side by side.

However, the existent building structural member described above is considerably heavy in weight and inconvenient to transport, requires much labor and time for construction, and as well as creates a problem also in the re-use of them after dismantling.

SUMMARY OF THE INVENTION

The present invention has been accomplished in view of the present situations for the building structural member of the aforementioned type and it is an object of the invention to provide a building structural members which is light in weight, can be manufactured at a low production cost and can be used for assembling into various shapes of interior and exterior walls of buildings in simple steps and in a short period of time.

For attaining the foregoing object, in accordance with an aspect of the present invention, there is provided a building structural member comprising a post pillar, or rod formed from a paper strip wound a cylindrical shape by spirally winding the strip and securing adjacent successive laminations thereof to each other with adhesives.

In a preferred embodiment, the building structural member described above has a peeling strength of not less than 13.0 kg/cm$^2$ and a compression strength of not less than 250 kg/cm$^2$.

The building structural member according to the present invention comprises structural support member formed of a paper strip wound into a cylindrical shape by spirally winding the same and securing adjacent successive laminations by means of adhesives, and the building structure member can be used for creating interior and exterior walls of buildings in simple steps.

The building structure member in the preferred embodiment of the present invention comprises a general cylindrical port formed of a paper strip wound into a cylindrical shape by spirally winding the paper strip and securing adjacent susscesive laminations by means of adhesives. The paper strip has a peeling strength of not less than 13.0 kg/cm$^2$ and a compression strength of not less than 250 kg/cm$^2$, and the building structural member can be used for interior and exterior walls of buildings with sufficient strength.

DETAILED DESCRIPTION OF THE EMBODIMENTS

Figure 1:
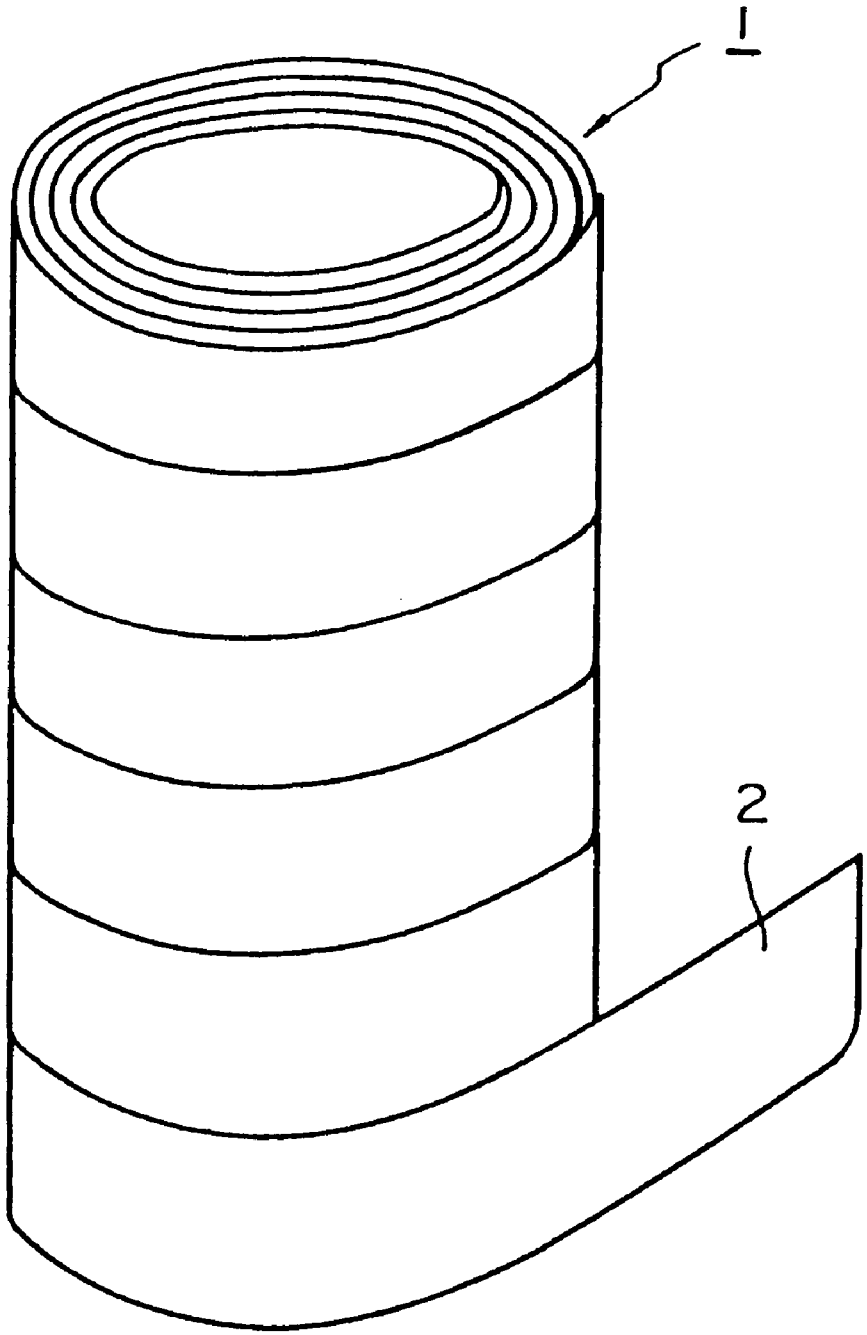
FIG. 1 is an explanatory view illustrating the constitution of a preferred embodiment according to the present invention.

The present invention is to be explained by way of a preferred embodiment with reference to FIG. 1.

FIG. 1 is an explanatory view illustrating the constitution of the preferred embodiment.

In the present invention, as shown in FIG. 1, an elongate paper strip 2 formed from base paper having 521 g/m$^2$ of unit weight, 0.72 g/cm$^3$ of bulk density and 0.7 mm of thickness is spirally wound to form twenty two layers, adjacent parts of successive laminations thereof are bonded by means of polyvinyl alcohol resin type adhesives. The paper strip 2 is laminated into a cylindrical shape, and the outside surfaces applied with a water proof treatment with paraffin to form a paper pipe 1 as a building structural member. The bulk density is represented as (A/S)/d in which S is the area, A is the mass and d is the thickness d of the paper, so that the bulk density is obtained by dividing the mass per unit area by the thickness d.

In the present invention of the above-mentioned constitution, a structure having a compression strength of not less than 250 kg/cm$^2$ and a peeling strength of not less than 13.0 kg/cm$^2$ can be obtained.

The present inventor confirmed that a tent house of 4 m height at a pole can be assembled by using the paper pipe 1 according to the present invention and daily life is possible at the inside of the tent under usual environmental conditions. In this case, paper pipes 1 applied with a water proof treatment with paraffin, each of 33 cm outer diameter, 15 mm thickness and 4 m height are inserted by the number of 48 into PC bases and arranged along a circle, integrated at upper ends with compressions made of wood, on which a roof of a tent is laid to constitute a tent house.

Further, the present inventor assembled a hall for holding an exhibition by assembling it out of the paper pipes 1 according to this embodiment and could provide such a hall used for continuous six months with no trouble. In this case, the roof of the hall was formed with space frames supported by iron frames, a total of three-hundred five paper pipes 1, each of 53 cm outer diameter, 15 mm thickness and 8 m length, are used for all of interior and exterior walls below the space frames, and eighteen paper pipes 1 each of 123 cm outer diameter and 8 m length are used to build a toilet booth. A cross-shaped wooden rib set to foundations by anchors is inserted to the base of the paper pipe 1, and the upper end of the pipe is secured by capping a coping prepared by stacking structural plywood sheets to a bolt protruding from the wooden rib. The coping is secured with globes of the space frame at each 2 m interval to constitute entire walls.

In the construction of the buildings using the paper pipes 1 of the embodiment, the paper pipes 1 themselves can be used as they are for the constituent members of the interior and exterior walls without finishing or without using substrates. The weight of the paper pipe 1 of 8 m length is about 130 kg, which is significantly lighter than solid lumber or concrete columns or port employed to present, convenient to transport and can construct buildings efficiently in a short period of time.

An example of a cylindrical paper pipe of circular cross section is shown in the illustrated embodiment, but a cylindrical paper pipe of a polygonal cross section may also be used.

Explanation is to be made for a strength test conducted for this embodiment.

(1) Compression Test

Two types of paper pipes, one having an outer diameter of about 150 mm and an inner diameter of about 125 mm and the other having about 100 mm of an outer diameter and about 75 mm of an inner diameter were used as specimens for a compression test as shown in Table 1. Five specimens were used for each of the types and paper gages were appended (four in total) at a central portion in the axial direction of the material and a direction perpendicular thereto, to determine Young's modulus and Poisson's ratio.

TABLE 1

Dimension for Specimen

| a: Paper pipe of 150 mm outer diameter, 125 mm inner diameter | | | | a* Paper pipe of 100 mm outer diameter, 75 mm inner diameter | | | |
|---|---|---|---|---|---|---|---|
| No. | Outer dia mm | Inner dia mm | Cross sectional area $cm^2$ | No. | Outer dia mm | Inner dia mm | Cross sectional area $cm^2$ |
| 1 | 150.75 | 124.69 | 56.38 | 1 | 99.78 | 75.07 | 33.259 |
| 2 | 150.76 | 124.78 | 56.22 | 2 | 99.84 | 75.16 | 33.495 |
| 3 | 150.78 | 124.86 | 56.11 | 3 | 99.64 | 75.16 | 33.495 |
| 4 | 150.80 | 124.84 | 56.20 | 4 | 99.75 | 75.05 | 33.200 |
| 5 | 150.84 | 124.72 | 56.53 | 5 | 99.88 | 75.22 | 33.653 |

Figure 2:
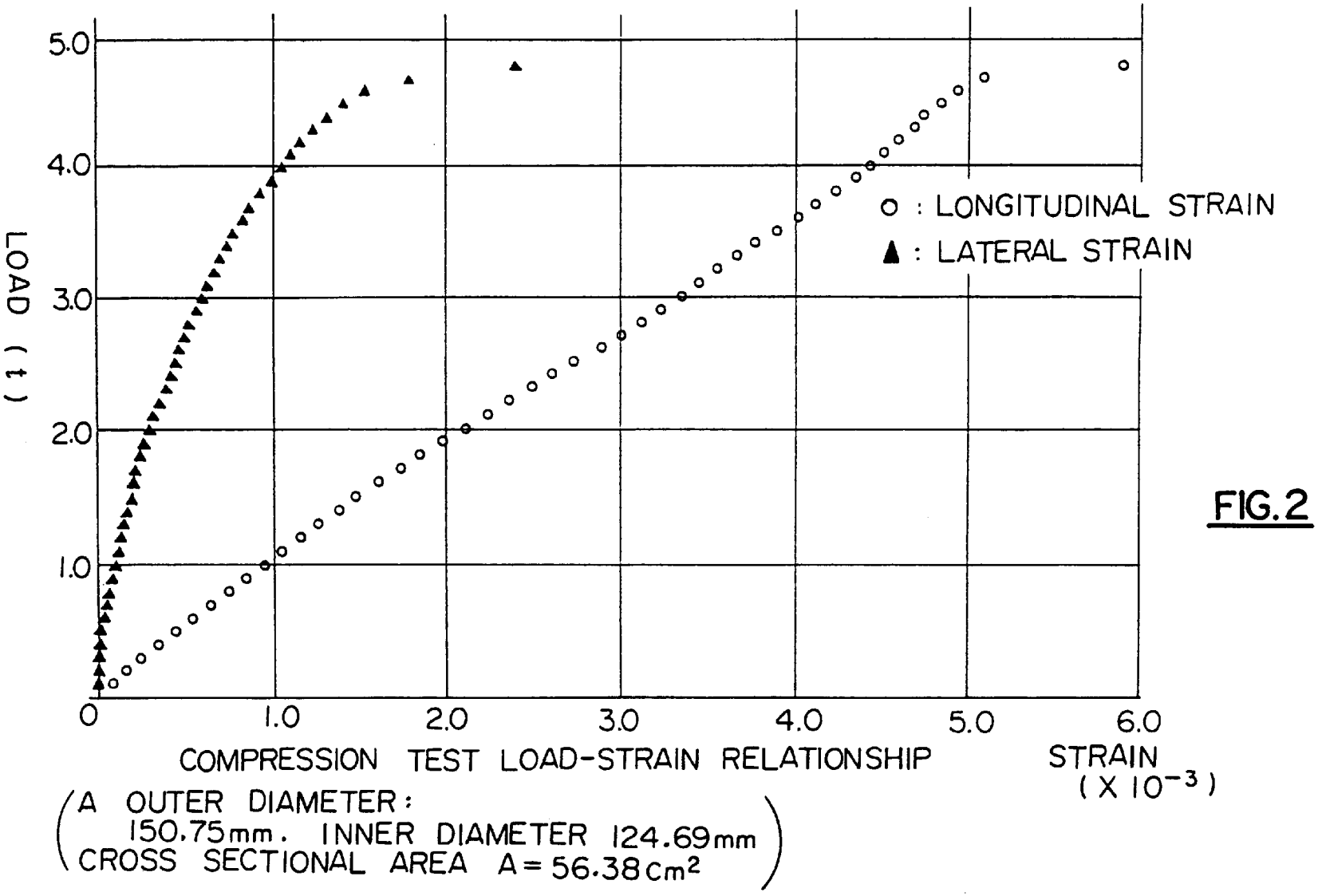
FIG. 2 is a characteristic graph illustrating an example of load-strain characteristic obtained by a compression test of the embodiment.

A compression test was conducted by placing a ball seat to a lower bed, laying a plate and setting a specimen thereon and laying a plate also on the upper end of the specimen, and under a load rate of 2–4 $kg/cm^2$/min. FIG. 2 shows an example of measuring data by the load test.

The data for each of the test specimens and average data obtained from the specimen of each of the sizes in the compression test are as shown in Table 2.

TABLE 2

Result of Compression Test

| Specimen No. | A ($cm^2$) | P (kg) | σmax ($kg/cm^2$) | E ($x10^4$ $kg/cm^2$) | υ |
|---|---|---|---|---|---|
| a-1 | 56.38 | 4840 | 85.8 | 1.76 | 0.125 |
| a-2 | 56.22 | 4700 | 83.6 | 1.69 | 0.135 |
| a-3 | 56.11 | 5215 | 92.9 | 1.90 | 0.169 |
| a-4 | 56.20 | 5110 | 90.9 | 1.73 | 0.169 |
| a-5 | 56.53 | 4975 | 88.0 | 1.87 | 0.187 |
| Average | | | 88.2 | 1.79 | 0.157 |
| a*-1 | 33.26 | 3335 | 100.3 | 1.86 | 0.192 |
| a*-2 | 33.50 | 3640 | 108.7 | — | — |
| a*-3 | 33.50 | 3405 | 101.7 | 1.88 | 0.180 |
| a*-4 | 33.20 | 3452.5 | 104.0 | 1.89 | 0.197 |
| a*-5 | 33.65 | 3405 | 101.2 | 1.82 | 0.187 |
| Average | | | 103.2 | 1.86 | 0.187 |

(2) Bending Test

Paper pipes each of 2 m length, 150 mm outer diameter and 125 mm inner diameter were used by the number of five as shown in Table 3.

TABLE 3

Size of Specimen

| Specimen No. | Outer dia (mm) | Inner dia (mm) | Geometrical moment of second order ($cm^2$) | Section modulus ($cm^3$) |
|---|---|---|---|---|
| b-1 | 150.33 | 124.91 | 1312.01 | 174.55 |
| b-2 | 150.40 | 124.90 | 1317.07 | 175.14 |
| b-3 | 150.26 | 124.72 | 1414.60 | 174.98 |
| b-4 | 150.29 | 124.83 | 1312.41 | 174.65 |
| b-5 | 150.54 | 124.08 | 1319.53 | 175.31 |

The bending test was conducted by placing a wooden beam on a lower bed of a testing machine, on which both ends of the specimen were supported, a pressure plate was also made as a wooden device, and pressure was applied to a central portion of a specimen by way of the pressure plate at a span of 185 cm and under a load rate of 7 $kg/cm^2$/min concentrically. The displacement was measured at the positions for the lower bed and the pressure plate, and the fulcrum and the floor position, and a central displacement is defined as a value subtracting the latter from the former.

According to the bending test, occurrence of wrinkles is observed along a winding angle of the elongate paper strip 2 at the upper end undergoing bending compression.

Figure 3:
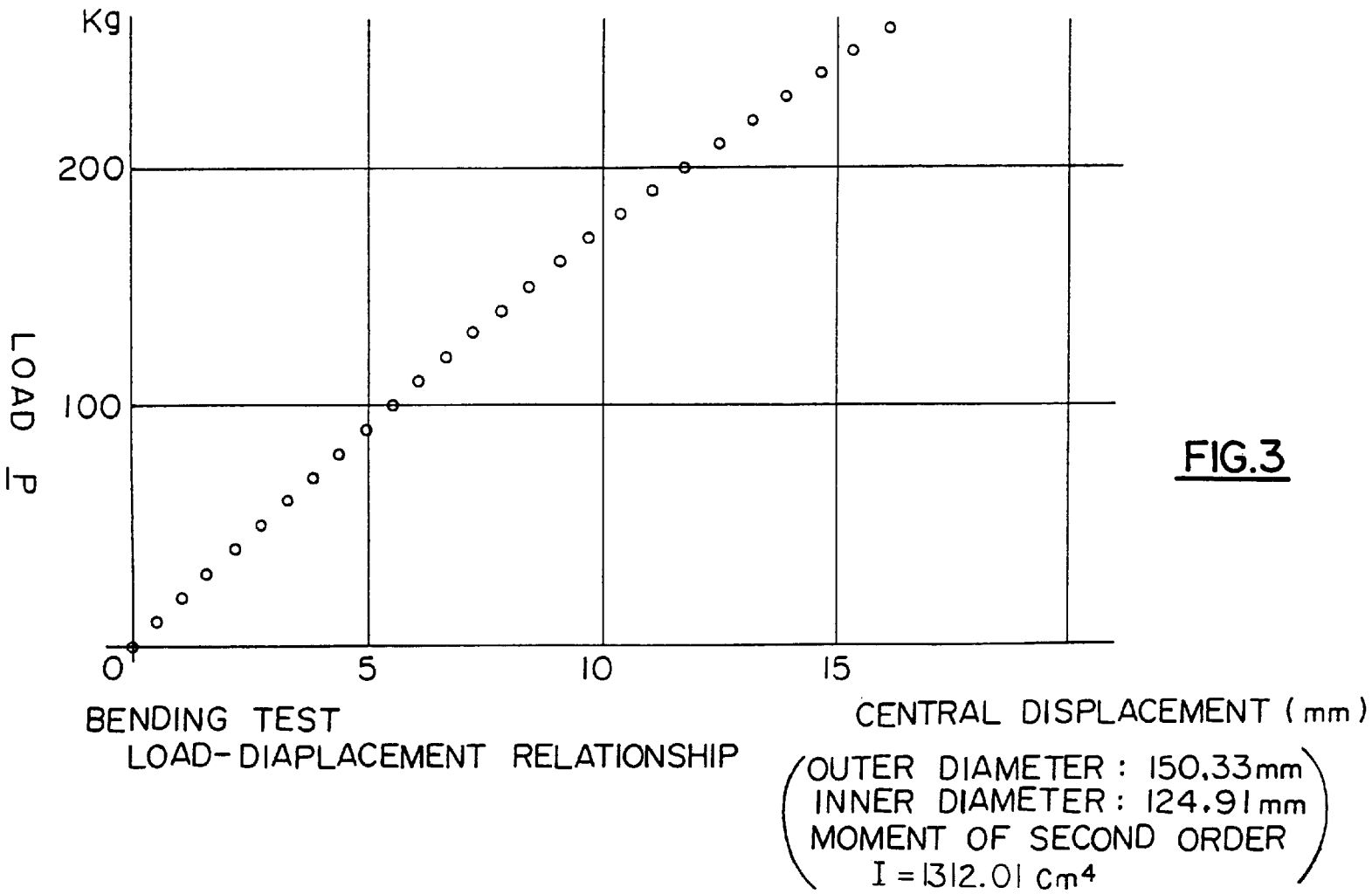
FIG. 3 is a characteristic graph illustrating an example of load-displacement characteristic obtained by a bending test of the embodiment.

FIG. 3 shows an example of load-displacement characteristic obtained by the bending test, and it is shown that the displacement increases linearly as far as the maximum strength.

Table 4 shows data for the strength and the Young's modulus for each of the specimens obtained by the bending test. The resultant average strength is 145 $kg/cm^2$, which is 1.65 times as large as the compression strength in a case of a paper pipe of 150 mm outer diameter, while the Young's modules is $1.67\times10^4$ $kg/cm^2$, which is reduced by about 7% than the value obtained by the compression test, which is table to compressible strain at a pressure point.

TABLE 4

Result of Bending Test

| Specimen No. | I ($cm^2$) | Z ($cm^3$) | Pmax (kg) | σmas $kg/cm^2$) | E ($x10^4$ $kg/m^2$) |
|---|---|---|---|---|---|
| 1 | 1312 | 174.5 | 567.5 | 150 | 1.74 |
| 2 | 1317 | 175.1 | 549.0 | 145 | 1.62 |
| 3 | 1315 | 175.0 | 513.0 | 136 | 1.64 |
| 4 | 1312 | 174.6 | 576.0 | 153 | 1.72 |
| 5 | 1320 | 175.4 | 540.5 | 143 | 1.65 |
| Average | | | | 145 | 1.67 |

(3) Creep Test

A creep test was conducted on five paper pipes 1 each of 400 mm length, 100 mm outer diameter and 75 mm inner diameter. Plates each of 6 mm thickness were set on both ends of the paper pipe 1, bolts were passed through a hole disposed to the central portion of the plate and clamped by a torque wrench until a predetermined torque value was reached. Then, the amount of displacement of the paper pipe 1 was read by attaching an electric dial gage to a lumber material and fitting it between plates. The measurement was conducted substantially at one week interval while clamping to a predetermined torque value before measurement.

Figure 4:
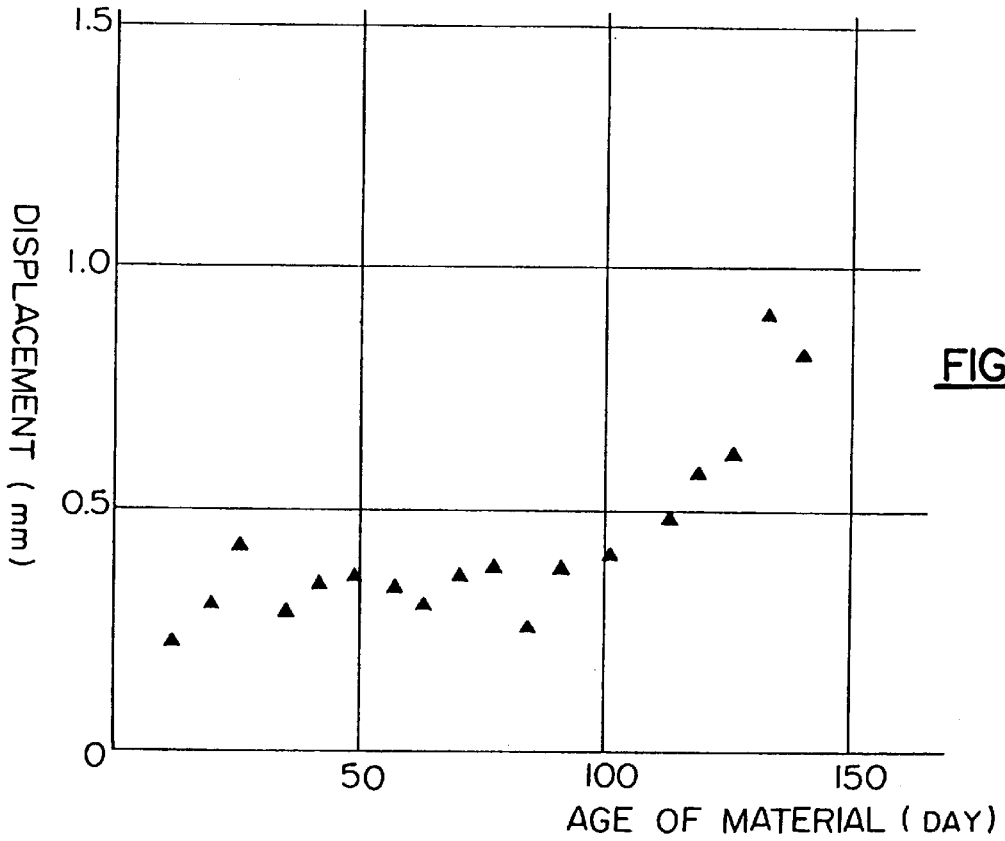
FIG. 4 is a characteristic graph illustrating a relationship between the age of material and the amount of displacement of the embodiment.
Figure 5:
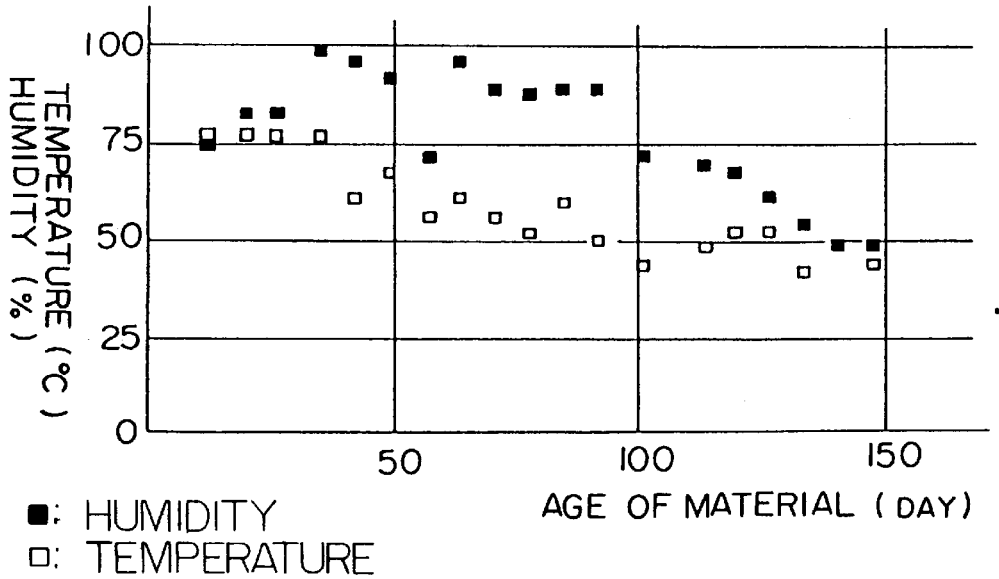
FIG. 5 is a characteristic graph illustrating a relationship between the age of material and the temperature and moisture of the embodiment.

FIG. 4 shows a relationship between the age of material and the amount of displacement obtained by the creep test and FIG. 5 shows a relationship between corresponding age of material and room temperature and humidity.

As shown in FIG. 4, the displacement was substantially constant at about 0.337 mm on average up to about 100 days of material age, and the displacement was remarkably increased thereafter and reached 1.03 mm at 147 days. Further, as apparent by comparison with FIG. 5, humidity gives an effect on the amount of displacement and the amount of displacement tends to increase as the humidity decreases.

Figure 6:
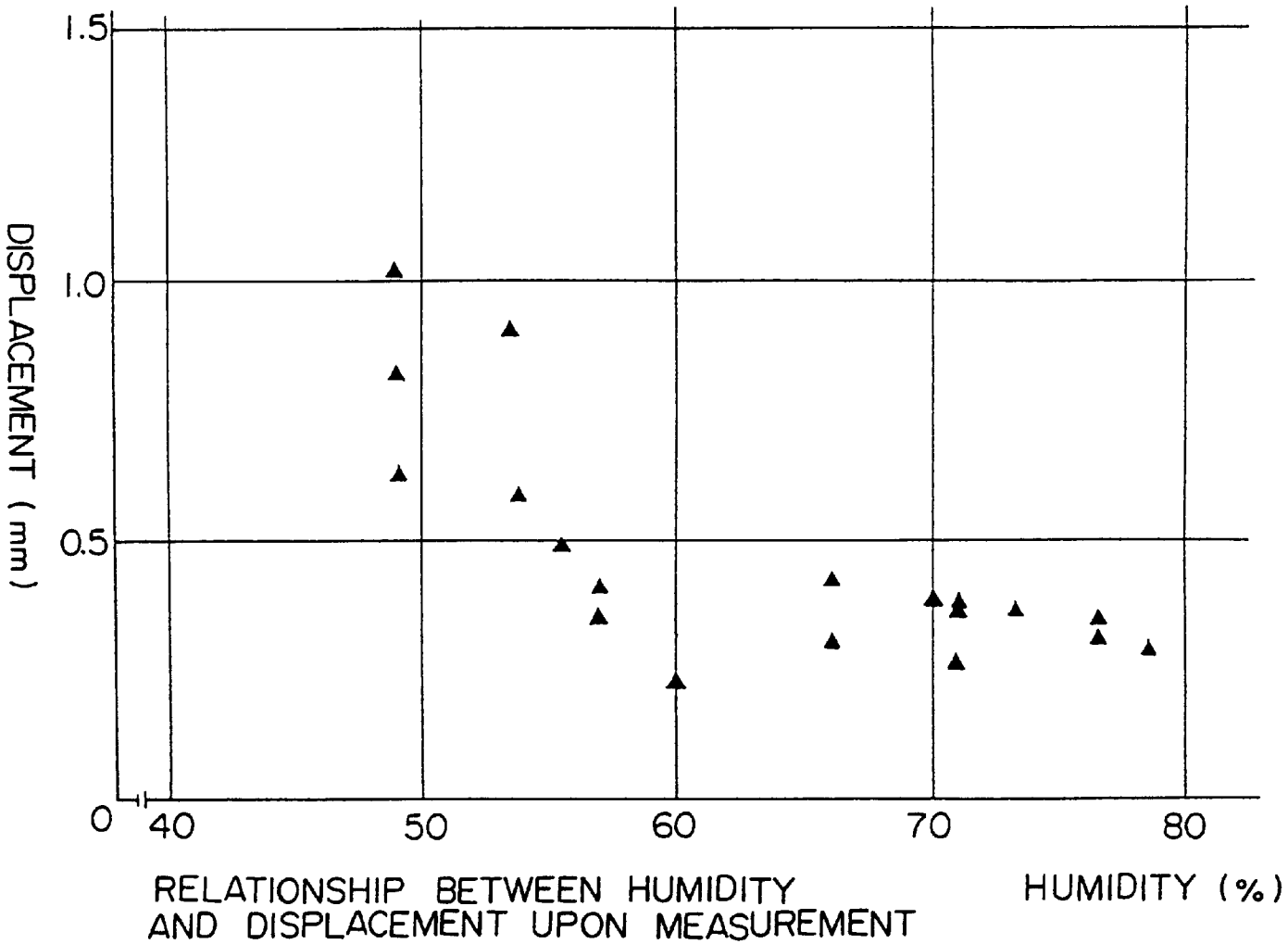
FIG. 6 is a characteristic graph illustrating a relationship between the moisture and the amount of displacement of the embodiment.

FIG. 6 is a characteristic graph illustrating a relationship between the humidity and the amount of displacement, clearly showing that the amount of displacement by the creep is reduced at low humidity.

As has been described above, the paper pipes of this embodiment can be manufactured at a reduced production cost using simple procedures, are light in weight and convenient to transport and can be used for forming various kinds of wall materials in a short period of time when they are used as they are without using substrates, and the paper pipes 1 can be re-used. This embodiment enables to construct buildings by simple steps, in a short period of time at a low production cost, and the buildings thus constructed can be used comfortably and efficiently for a long period of time.

As has been described above according to the present invention, since the building structural member comprises a paper strip formed into a cylindrical shape by spirally winding and securing adjacent opposed laminations by means of adhesives, interior and exterior walls of the buildings can be manufactured by using the building structure in simple steps and at a reduced production cost.

In addition to the above-mentioned advantageous effects, since the peeling strength is not less than 13.0 $kg/cm^2$ and a compression strength is not less than 250 $kg/cm^2$ according to the present invention, the interior and the exterior walls of buildings can be constructed with sufficient strength.

What is claimed is:

1. A tubular structural member adapted for supporting a vertical axial load, comprising an elongated paper strip that is spirally wound as a seamless cylindrical member formed of a plurality of laminations, and an adhesive applied between successive laminations of said spirally wound paper strip so that said tubular structural member is substantially rigid, wherein said paper strip and said adhesive are selected such that the tubular structural element has a peeling strength of not less than 13.0 $kg/cm^2$ and a compression strength of not less than 250 $kg/cm^2$; and a waterproof treatment applied onto an outer surface of the tubular structural member and covering substantially the entire outer surface thereof.

2. The tubular structural member of claim 1 wherein said waterproof treatment includes a paraffin.

3. A tubular structural member comprising an elongated paper strip that is spirally wound as a seamless cylindrical member formed of a plurality of laminations, wherein said elongated paper strip forms all said laminations, and an adhesive applied between successive laminations of said spirally wound paper strip so that said tubular structural member is substantially rigid wherein said paper strip and said adhesive are selected such that the tubular structural element has a peeling strength of not less than 13.0 $kg/cm^2$ and a compression strength of not less than 250 $kg/cm^2$; and a waterproof treatment applied onto an outer surface of said tubular structural member and covering substantially the entire outer surface thereof.

4. The tubular structural member of claim 3, wherein said waterproof treatment includes a paraffin.

* * * * *

UNITED STATES PATENT AND TRADEMARK OFFICE

CERTIFICATE OF CORRECTION

PATENT NO. : 6,085,484

DATED : July 11, 2000

INVENTOR(S) : Shigeru Ban

It is certified that error appears in the above-identified patent and that said Letters Patent is hereby corrected as shown below:

In Col. 1, line 22: "structural member or element" should read --structural members or elements--

In Col. 1, line 26: "port or pillows" should read --posts or pillars--

In Col. 1, line 32: "member" should read --members--

In Col. 1, line 49: insert a comma (,) between post pillar

In Col. 1, line 50: insert the word --into-- between "wound" and "a"

In Col. 1, line 67: "general cylindrical port" should read --generally cylindrical post--

In Col. 2, line 2: "susscesive" should read --successive--

In Col. 2, lines 40 & 41: "layers, adjacent" should read --layers. Adjacent--

In Col. 2, line 44: "surfaces" should read --surface is--

In Col. 3, line 22: "port" should read --posts--

In Col. 4, line 65: "modules" should read --modulus--

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*